US007018521B2

(12) United States Patent
Wang et al.

(10) Patent No.: US 7,018,521 B2
(45) Date of Patent: Mar. 28, 2006

(54) METHOD OF PRODUCING BRIGHT ANODIZED FINISHES FOR HIGH MAGNESIUM, ALUMINUM ALLOYS

(75) Inventors: Yar-Ming Wang, Troy, MI (US); Hong-Hsiang Kuo, Troy, MI (US); Sheila Farrokhalaee Kia, Bloomfield Hills, MI (US)

(73) Assignee: General Motors Corporation, Detroit, MI (US)

( * ) Notice: Subject to any disclaimer, the term of this patent is extended or adjusted under 35 U.S.C. 154(b) by 727 days.

(21) Appl. No.: 09/963,625

(22) Filed: Sep. 27, 2001

(65) Prior Publication Data

US 2003/0057100 A1 Mar. 27, 2003

(51) Int. Cl.
*C25D 11/18* (2006.01)
*C25D 11/16* (2006.01)
*C25D 5/34* (2006.01)

(52) U.S. Cl. ..... 205/202; 205/213; 205/219

(58) Field of Classification Search ..... 205/328, 205/205, 219, 202, 213
See application file for complete search history.

(56) References Cited

U.S. PATENT DOCUMENTS 4,601,796 A 7/1986 Powers et al.
4,806,211 A 2/1989 Timm et al.
5,166,020 A * 11/1992 Fukuda et al. ..... 430/58
5,181,969 A * 1/1993 Komatsubara et al. ..... 148/552
5,616,231 A * 4/1997 Askin et al. ..... 205/153
5,760,981 A * 6/1998 Gillich ..... 359/883
5,975,976 A * 11/1999 Sekinger et al. ..... 445/50
6,309,427 B1 * 10/2001 Korte ..... 8/685

OTHER PUBLICATIONS

Wernick et al., "Decorative and Proctective Anodizing", The Surface Treatment and Finishing of Aluminum and Its Alloys, Chapter 7, p. 376, month unavailable, 1987.*

* cited by examiner

*Primary Examiner*—Edna Wong
(74) *Attorney, Agent, or Firm*—Kathryn A. Marra

(57) ABSTRACT

A method is disclosed for forming a clear anodized coating on an aluminum base alloy containing more than three percent by weight magnesium. The alloy surface to be anodized is treated with an aqueous solution of a mineral acid such as sulfuric acid (10 to 20%), nitric acid (10 to 30%) or phosphoric acid (40 to 80%) under the influence of a relatively low voltage direct current. This treatment suitably reduces the magnesium content of the surface layer and, subsequently, a relatively low current density anodization in sulfuric acid produces the clear coating. The clear coating may then be colored by known processes.

4 Claims, 1 Drawing Sheet

METHOD OF PRODUCING BRIGHT ANODIZED FINISHES FOR HIGH MAGNESIUM, ALUMINUM ALLOYS

TECHNICAL FIELD

This invention pertains to a process for obtaining a clear and glossy anodized coating on aluminum alloys containing more than about four percent by weight magnesium. More specifically, this invention pertains to a process for forming such an anodized coating that can be used to produce an acceptable finish surface for an automobile component.

BACKGROUND OF THE INVENTION

The desire to produce lower weight automobiles has led to the use of increased amounts of aluminum alloys in powertrain and body components. This usage is now extending to high magnesium content, aluminum sheet alloys that are capable of undergoing high elongation and substantial deformation into automobile body panels of complex shape. These aluminum alloys have a suitable composition and metallurgical microstructure for "superplastic forming" (SPF) on stretch form tooling at elevated forming temperatures. Aluminum Alloy 5083 is an example of a SPF sheet metal alloy that is now stretch formed at temperatures in the range of, e.g., 450 to 500° C. to form one piece vehicle deck lid panels, tailgate panels, door panels, quarter panels, and the like.

In an assembled vehicle, exterior panels have to be painted or otherwise decoratively finished. Of course, aluminum body panels can be spray painted because spray painting is the state-of-the-art automobile industry practice for producing commercially acceptable decorative finishes, sometimes termed Class-A finishes, for all types of substrates. However, there is practical interest in developing other finishing processes for aluminum alloy panels and other components. A known possibility is to anodize the surface of the aluminum panel and then decorate it by a coloring method. Anodizing of some aluminum alloys has been practiced for many years.

Anodizing is an electrochemical process in which an aluminum alloy part is made the positive electrode (anode) in an acid electrolyte (e.g., sulfuric acid) and a voltage is applied to establish the desired polarization to establish oxygen at the surface. This electrochemical process thickens and toughens the naturally occurring oxide and the resulting aluminum oxide substance is very hard.

In the electrochemical process the aluminum surface reacts with oxygen to produce adherent, oxide coatings:

$$2Al+5H_2O \rightarrow Al_2O_3+O_2\uparrow+5H_2\uparrow$$

In the sulfuric acid anodizing process, the oxide is slowly dissolved by the electrolyte and a porous oxide coating is produced. The net coating growth rate and its porosity depends on the equilibrium set up between the film growth and dissolution. Typical anodized oxide thicknesses are in the range of five to thirty micrometers (μm) and a typical pore diameter is about twenty nanometers (nm). The porous structure allows secondary infusions such as organic and inorganic coloring, lubricity aids and the like.

Thus, the color anodizing of aluminum alloys is also a known art. But the results vary with the composition of the alloys. Alloying elements in the aluminum sheet affect the color of its anodized coating and the ability to achieve commercially acceptable finishes. For example, aluminum alloys containing more than about two to three percent by weight of magnesium tend to form dark gray anodized coatings by known anodizing processes.

A typical composition of AA5083 is, by weight, 4.60% magnesium, 0.79% manganese, 0.10% silicon, 0.02% copper, 0.18% iron, 0.01% zinc, 0.11% chromium, 0.01% titanium and the balance aluminum. This alloy composition, together with special thermo-mechanical processing of the sheet permits it to be processed by SPF into complex and durable body panel configurations. But the high magnesium content yields a gray, often dark, anodized finish by known anodizing practices. Furthermore the anodizing process results in a rough and low gloss surface. Despite repeated efforts, it is found that the anodized layer on an AA5083 sheet cannot be colored by known practices to yield commercially acceptable exterior panels for the automobile industry.

The literature of the prior art confirms this experience. For example, the text, "The Surface Treatment and Finishing of Aluminum and Its Alloys", Wernick, Pinner and Sheasby, 1987, describes the effects of various alloying elements on the appearance of anodized commercial aluminum alloys. This text states that magnesium containing, aluminum alloys can give clear colorless anodized coating for magnesium up to 3% by weight. U.S. Pat. No. 4,601,796 entitled High Reflectance Semi-Specular Anodized Aluminum Alloy Product and Method of Forming Same, Powers and Dang, describes a method for obtaining a clear anodized layer for magnesium contents of only 0.25 to 1.5 weight percent magnesium.

However, it would now be very useful to produce clear anodized aluminum oxide coatings on aluminum alloys containing more than three percent by weight magnesium. Such coatings could be colored or finished by some other process to make automotive panels and other useful articles. Accordingly, it is an object of this invention to provide a process for forming such coatings and products. It is a more specific object of this invention to devise a method of producing a clear and glossy anodized aluminum oxide layer on a high magnesium content, aluminum alloy material of the type used in automotive vehicle external panels. The need is to provide such a coating that can be then provided with a colored or clear finish acceptable for commercial vehicle use (i.e., a Class A finish).

SUMMARY OF THE INVENTION

This invention provides basic chemical and/or electrochemical approaches to the surface treatment of certain high magnesium content aluminum alloys that have physical properties suitable for vehicle body and/or chassis components. In short, this invention provides a method for producing a clear anodized oxide layer (in contrast to a dark or colored surface layer), of suitable thickness on the surface of such components. And when the surface of the part has to be colored, the layer is sufficiently smooth, as indicated, e.g., by its gloss level, that it can be dyed or electrochemically colored or otherwise decorated to an automotive Class A finish.

In a preferred embodiment, the invention is applied to a SPF sheet metal alloy such as AA5083 that has been shaped by a SPF process into an automobile body panel such as a deck lid or a door panel. After forming and cleaning, the panel is optionally subjected to a pre-anodizing process to selectively reduce the magnesium content of the surface to be anodized. Then, with or without such magnesium content reduction, the surface is carefully anodized at a suitably low current density to provide a uniform layer of aluminum oxide columnar crystals. The layer typically has a thickness in the range of about five to twenty-five micrometers. Furthermore, the oxide coating is visually clear and has a glossy, reflective surface.

Thus, in the practice of this invention particular care is taken during processing of the surface to be anodized to prevent the high magnesium content of the aluminum alloy from causing the oxide growth process to yield the conventional rough and dark coating. It is the inventors' belief that all prior art anodizing practices as applied to aluminum alloys containing more than about 3% by weight magnesium result in selective and overly rapid dissolution of the magnesium from the alloy surface. These practices yield rough and uneven base metal and oxide surfaces that are gray, displaying highly scattered reflectance of light.

Consequently, in accordance with one embodiment of this invention, the magnesium content of the clean sheet metal surface is reduced by treatment with a mild acid solution. The mild acid treatment may be enhanced electrochemically as will be described. This magnesium reduction treatment precedes low current density anodization.

In accordance with a second embodiment of the invention, no separate magnesium reduction step is used. The cleaned aluminum alloy surface is slowly anodized in aqueous sulfuric acid at room temperature and at a current density in the range of about three to ten amperes per square foot ($A/ft^2$) of anodized surface. It is found, surprisingly, that suitable low current density anodizing apparently nullifies the adverse effect of magnesium on the color and reflectance of the oxide layer.

When acid pretreatment is employed it typically follows alkaline cleaning of the part so that its surface is essentially bare metal with minimal oxide coating. The pretreatment involves the use of mild aqueous solutions of sulfuric acid (preferably 10 to 20% by weight) or nitric acid (preferably 10 to 30%) or phosphoric acid (preferably 40 to 80%). Mixture of these solutions may be used. The aqueous acid solution is preferably warmed to about 60 to 70° C. The formed AA5083 part, for example, is immersed in the solution for a period of minutes until the magnesium content of the surface layer, to a depth of a few micrometers, is selectively reduced below three percent by weight. The acid pretreatment process may be enhanced by direct current electrochemical processing. The purpose of the acid pretreatment is to selectively remove surface layer magnesium while smoothening and not roughening the surface of the formed part.

Anodization is preferably conducted in an aqueous sulfuric acid bath suitably containing 100 grams to 200 grams $H_2SO_4$ per liter of bath. Typically, anodization is conducted under carefully controlled bath temperature conditions and that practice is to be followed in this invention. For example, a suitable temperature range is 18 to 25° C. However, in order to produce a clear and smooth oxide coating up to twenty five micrometers thick, it is necessary to conduct oxide formation at a current density below prior art levels. Preferably, anodization is accomplished at a direct current density of three to ten $A/ft^2$. The selected current density level depends on the desired thickness of the oxide coating with lower current densities being preferred for thinner layers, and vice versa.

With or without acid pretreatment for reducing surface magnesium content, the low current density anodizing process is conducted to produce a clear, smooth finish on the formed automotive body part so as to permit subsequent finishing, e.g., coloring, to a Class A automotive quality.

Other objects and advantages of the invention will become more apparent from detailed descriptions of preferred embodiments of the invention.

DESCRIPTION OF PREFERRED EMBODIMENTS

Figure 1:
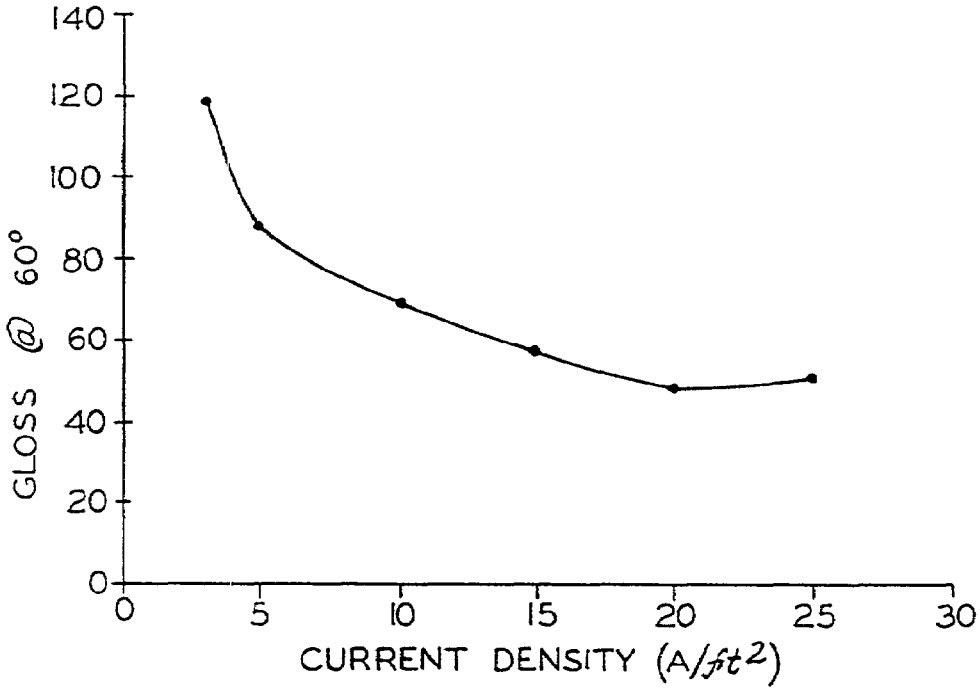
FIG. 1 is a graph showing the effect of current density on the gloss (at 60° illumination angle) of 7–10 μm thick anodized coatings on AA5083 sheet samples produced at a total charge of 300 ampere minutes per square foot of anodized surface. The graph is a plot of gloss vs. current density in $A/ft^2$.

The main alloying element in the AA5000 series of alloys is magnesium. Anodizing articles made from those alloys of the 5000 series with less that 3% magnesium will usually produce clear colorless coatings. However, when the alloy contains more than three percent by weight magnesium, the normal anodizing procedures will yield only light to dark gray coatings. The anodized surfaces on articles of such alloys cannot then be colored to produce a bright colorful decorative surface.

In order to illustrate embodiments of this invention, small panel specimens of AA5083 alloy sheet material were obtained for processing. As stated above, this aluminum alloy included 4.60% by weight magnesium.

The surfaces of panel specimens were manually polished using a polishing wheel to provide a standard surface for evaluation of the subject acid pretreatment and anodizing practices. The polishing was done using a random-orbital sander with progressively finer sanding pads and ended with 1500 grit pads.

The polished specimens were then cleaned for up to ten minutes in an aqueous alkaline cleaning tank at 60° C. using a commercial cleaner. The cleaned specimens were rinsed in water.

After rinsing, the small panels were treated to reduce their surface layer magnesium content and to produce a smooth glossy surface. In this surface treatment prior to anodizing the panels were electrochemically treated as anodes in aqueous 80% phosphoric acid solution at 65° C. for ten minutes. A dc voltage of twenty volts was applied during the processing with the respective panels arranged as the anode in the electrolytic cell. Stainless steel (316) cathode bars were used. The panel anodes became polarized and magnesium ions formed at the surface which were removed into the acid bath. These conditions had been predetermined as suitable for reducing the magnesium content below 3% by weight to a depth of one to five micrometers.

The effect of various acid treatments on magnesium content is evaluated by determining the residual magnesium content of the surface region treated. One surface analysis technique is to sputter the surface atoms from the surface and analyze the emitted atoms by using Auger electron analysis (AES) for sputtered magnesium. A beam of energetic electrons, 3 to 25 keV, is used to eject a core level electron from surface atoms. To release energy, those atoms may emit Auger electrons from their induced excited state.

The energy of the Auger electron, specific to the atom from which it originated, is measured and the quantity of Auger electrons is proportional to the concentration of the atoms on the surface. Auger electron spectroscopy can measure two dimensional maps of elements on a surface and elemental depth profiles when accompanied by ion sputtering.

Reduction of surface magnesium content has also been accomplished using a mixture of 80% by weight phosphoric acid, 5% by weight nitric acid and the balance water without an electrical current. AA 5083 panels were dipped in this acid solution at 90° C. for periods of two to five minutes. The mixture of acids chemically smoothes the surface producing a near mirror finish. Moreover, the magnesium content of the upper 5 micrometers was reduced to less than three percent by weight.

EXAMPLE 1

Following the acid electrochemical treatment for magnesium removal, samples were anodized under varying conditions as follows. Anodizing was carried out in a sulfuric acid bath containing 160 grams $H_2SO_4$ per liter of bath, suitably 100–200 grams per liter. In a first series of tests respective panels were each given a total charge of 300 Ampere minutes per square fool: of anodized surface to produce oxide layers seven to ten micrometers thick. However, the current density was varied over the range from 3 A/ft$^2$ to 25 A/ft$^2$. The difference in the appearance of the films formed at different current densities was striking. In order to quantify differences in the oxide layers measurements were made of their thickness, reflectance or gloss and surface roughness.

The gloss of the sample surface was measured using a portable Micro-TRI Gloss meter (BYK-Gardner GmbH). The unit was placed directly on the sample and the gloss measurement was taken at both 60° and 85° illumination angles. The illumination angle is the angle between the axis perpendicular to the sample surface and directed light. The directed light reflected from the surface is measured photoelectrically and described by the reflectometer value R. This is a relative measurement based on the gloss value of 100 for a highly polished black glass plate with a refractive index of 1.567.

The oxide coating thickness was measured using a Fischerscope MMS unit (Fischer Technology, Inc.). This device uses an eddy current method to measure coating thickness. When a conductive material (aluminum) is subjected to an AC magnetic field from the probe, eddy-currents occur in the material in proportion to the frequency of the field and the resistivity of the material. The induced eddy currents generate an opposing magnetic field, which alters the circuit reactance and the output voltage of the probe. A non-conductive coating such as anodized coating introduces a gap (lift-off) between the probe and aluminum. This gap produces a loss in eddy current penetration, which is compared to a measurement directly on the base material to determine coating thickness.

Three-dimensional surface roughness was measured on the oxide/air and the metal/oxide interfaces by a non-contact Wyko Optical Profiler by Veeco Corporation. Due to the transparent nature of the aluminum oxide, double interference fringes occur at both the oxide/air surface and the metal/oxide interfaces, causing measurement problems. For an accurate oxide surface roughness measurement, a thin Au—Pd layer was vacuum-deposited onto the oxide/air surface to eliminate the interference fringe from the metal/oxide interface. To measure the metal surface roughness after anodizing, the oxide film was stripped off in a phosphoric/chromic stripping solution. Ra values, which are a measure of the surface profile arithmetic average deviation from the centerline, were used to quantify the surface roughness. In general, as surface roughness increases, gloss values decrease.

FIG. 1 is a graph of the measured gloss values @ the 60° illumination angle vs. anodizing current density (from 3 to 25 A/ft$^2$) obtained on the cleaned and pretreated AA 5083 panels. In each case the thickness of the aluminum oxide coating was in the range of 7 to 10 μm resulting from the total applied charge of 300 Amp.min/ft$^2$. As described above, the gloss value is a relative measurement, a percentage of the gloss value of 100 for a highly polished black glass plate with a refractive index of 1.567.

Referring to FIG. 1, it is seen that the gloss values generally decrease as the anodizing current density was increased. And as the gloss values decreased, separate surface roughness measurements on the same panels confirmed that the coatings became rougher and eventually they darkened. At a current density of 3 A/ft$^2$, the panels had a gloss value of about 119. These panels had clear glossy coatings that provided the basis for a Class A automotive industry surface finish. At a current density of 5 A/ft$^2$, the gloss values had dropped to about 85, and at a current density of 10 A/ft$^2$ the gloss had fallen to about 70. The surfaces of the panels anodized at 10 A/ft$^2$ were considered only marginally suitable for automotive body surface applications. The panels anodized at still higher current density values were dark and rough and considered unsuitable for coloring or finishing for automotive body panel use.

EXAMPLE 2

A second set of AA 5083 panels was anodized to a higher total charge of 500 Amp.min/ft$^2$ to produce thicker coatings in the range of 15 to 20 μm. These panels had all been cleaned in the alkaline cleaner, rinsed and electrochemically pretreated in phosphoric acid to reduce their surface magnesium in the manner by which the Example 1 panels had been processed. Anodizing was carried out in a sulfuric acid bath like that in which the Example 1 panels were oxidized. And, as in Example 1, anodizing current densities in the range of 3 to 25 A/ft$^2$ were used. But the respective total anodizing treatment times were increased by two-thirds because of the greater total anodizing charge to produce the thicker coatings.

Figure 2:
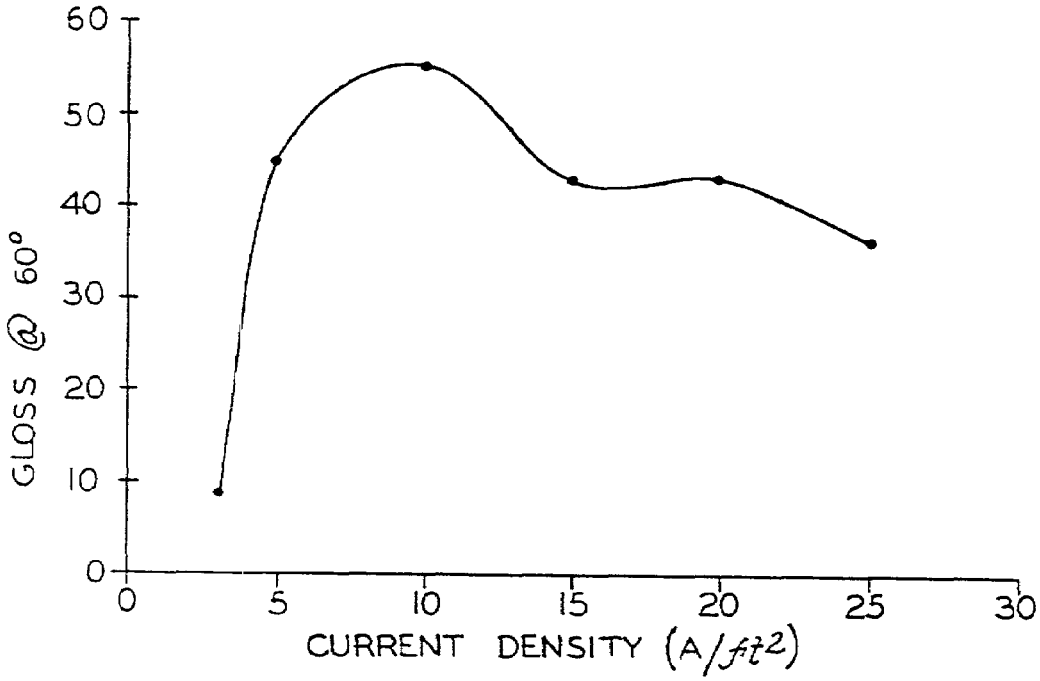
FIG. 2 is a graph showing the effect of current density on the gloss (at 60° illumination angle) of 10–20 μm thick anodized coatings on AA5083 sheet samples produced at a total charge of 500 ampere minutes per square foot of anodized surface. The graph is a plot of gloss vs. current density in $A/ft^2$.

FIG. 2 is a graph of gloss values at 60° illumination angle for the panels anodized at the various current densities to the greater total charge of 500 Amp.min/ft$^2$. It is seen that the combination of longer anodizing time and current density has produced a somewhat different result from the Example 1 panels. The most acceptable gloss values were obtained on the panels that were anodized at current densities in the range of 5 to 10 A/ft$^2$. At these current densities gloss values of 45 to 55% were obtained.

As stated, one reason for working to obtain clear anodized coating on high magnesium content, aluminum alloys is to then color them. But the color needs to applied to a clear and glossy aluminum oxide layer to reliably produce the desired color on a commercial scale and to produce a commercial quality finish. Following is a summary of three coloring methods that can be used with clear, glossy anodized layers.

1. Electrolytic Coloring (The two-step method)—After anodizing, the metal is immersed in a bath containing an inorganic metal salt. Current is applied which deposits the metal salt in the base of the pores of the aluminum oxide columns. The resulting color is dependent on the metal used and the processing conditions. Common used metals include tin, cobalt, nickel, and copper. This process offers color versatility and the most technically advanced coloring quality. The coatings can also provide excellent weather-fastness and light-fastness. Many structures built with these finishes have lasted more than 20 years. The color range can be broadened by over-dyeing the electrolytic colors with the organic dyes for a wider variety of colors and shades.

2. Organic Dyeing—In this coloring process the formed and anodized article is immersed in or otherwise coated with a dye solution. The organic dyeing process produces a wide variety of colors.

3. Interference Coloring—An additional coloring procedure, recently in production, involves modification of the pore structure produced in sulfuric acid. Pore enlargement occurs at the base of the pore. Metal deposition at this location produces colors ranging from blue, green and yellow to red. The colors are caused by optical-interference effects, rather than by light scattering as with the basic electrolytic coloring process. Further development will produce a greater variety of colors.

Accordingly, this invention provides processes for forming high gloss, clear anodized coatings on high magnesium content, aluminum alloys. Such coatings provide the basis for an attractive decorative finish on aluminum alloy articles. While the process and applications have disclosed in terms of a few specific embodiments, it is obvious that other forms of the methods and other applications can be adapted by those skilled in the art. Thus, the scope of the invention is to be considered limited only by the following claims.

What is claimed is:

1. A method of forming a colored bright anodized coating on a surface of an aluminum alloy article, where said alloy contains more than three percent by weight magnesium;

immersing said surface to be anodized in an aqueous acid solution at a temperature below about 100° C., said solution comprising one or more mineral acids selected from the group consisting of, by weight, ten to twenty percent sulfuric acid, ten to thirty percent nitric acid, and forty to eighty percent phosphoric acid until the magnesium content in said surface is reduced to less than three percent and to produce a glossy surface;

anodizing said surface in an aqueous sulfuric acid bath containing 100 to 200 grams of sulfuric acid per liter of bath at a temperature in the range of 18 to 25° C. and at a current density in the range of about 3 $A/ft^2$ to 10 $A/ft^2$ that produces a desired thickness of a clear anodized layer suitable for color finishing; and coloring said clear anodized layer to produce said colored coating.

2. A method as recited in claim 1 further comprising, during said immersing step, establishing said surface as an anode in a direct current circuit with said solution as an electrolyte and applying a direct current voltage of 10 to 25 volts to said surface.

3. A method of making a body component for an automotive vehicle, said component comprising a formed sheet of an aluminum alloy containing more than about four percent by weight magnesium, said method comprising forming said sheet into a body component having a surface requiring a decorative finish, immersing said surface to be anodized in an aqueous acid solution at a temperature below about 100° C., said solution comprising one or more mineral acids selected from the group consisting of, by weight, ten to twenty percent sulfuric acid, ten to thirty percent nitric acid, and forty to eighty percent phosphoric acid until the magnesium content in said surface is reduced to less than three percent and to produce a glossy surface, anodizing said surface in an aqueous sulfuric acid bath comprising 100 to 200 grams per liter of sulfuric acid at a temperature in the range of about 18 to 25° C. and at a current density in the range of about three to no more than ten amperes per square foot of said surface to form a clear coating of aluminum oxide having a thickness of about ten to 25 micrometers, and coloring said clear coating of aluminum oxide to produce said decorative finish.

4. A method as recited in claim 3 further comprising, during said immersing step, establishing said surface as an anode in a direct current circuit with said solution as an electrolyte and applying a direct current voltage of 10 to 25 volts to said surface.

* * * * *